United States Patent [19]

Bauer et al.

[11] Patent Number: 4,471,183

[45] Date of Patent: Sep. 11, 1984

[54] THREE-PHASE SWITCHGEAR

[75] Inventors: Johann Bauer, Ebermannsdorf; Joachim Hannich, Amberg; Werner Harbauer, Schwandorf, all of Fed. Rep. of Germany

[73] Assignee: Siemens Aktiengesellschaft, Munich, Fed. Rep. of Germany

[21] Appl. No.: 425,896

[22] Filed: Sep. 28, 1982

[30] Foreign Application Priority Data

Nov. 2, 1981 [DE] Fed. Rep. of Germany ..... 3143430

[51] Int. Cl.[3] ..... H01H 9/30

[52] U.S. Cl. ..... 200/144 R; 200/145; 200/146 R

[58] Field of Search ..... 200/144 R, 145, 10, 200/148 C, 146 R, 146 A, 286; 361/8, 12

[56] References Cited

U.S. PATENT DOCUMENTS 2,411,894 12/1946 Peters ..... 200/144 R
2,882,372 4/1959 Preissler ..... 200/146 R X
3,873,797 3/1975 Hannich ..... 200/308
4,000,480 12/1976 Gray et al. ..... 335/201 X

FOREIGN PATENT DOCUMENTS 951020 2/1957 Fed. Rep. of Germany .
2346928 7/1975 Fed. Rep. of Germany .

*Primary Examiner*—Joseph W. Hartary
*Assistant Examiner*—Morris Ginsburg
*Attorney, Agent, or Firm*—Kenyon & Kenyon

[57] ABSTRACT

A switchgear apparatus having three switching gaps with contacts arranged thereacross for connecting three-phase electrical power to a consumer. Apparatus is described whereby a selected one of the switching gaps closes earlier than the other switching gaps during a closing cycle of the switchgear, and opens later than the other switching gaps during an opening cycle of the switchgear. The contacts across the early closing and late opening gap experience only minimal contact burn-off, thereby permitting a substantially reduced volume of contact overlay material to be provided therefor. In addition, less expensive contact material may be utilized for this contact.

7 Claims, 1 Drawing Figure

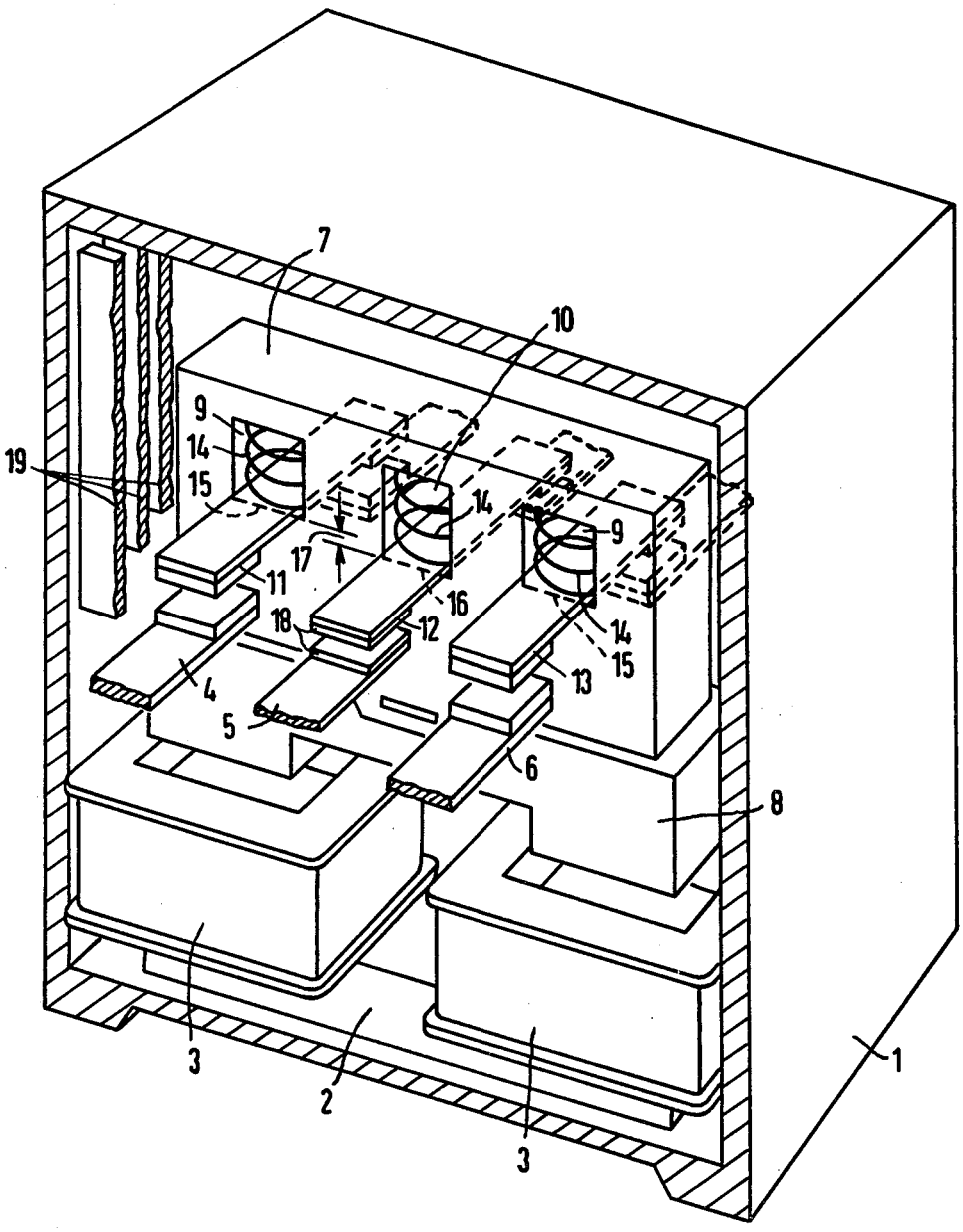
7
10
9
14
15
19
17
11
16
18
12
14
15
13
4
5
6
8
3
2
3
1

THREE-PHASE SWITCHGEAR

BACKGROUND OF THE INVENTION

This invention relates generally to power switching equipement, and more particularly to switchgear for connecting three-phase power for a consumer, the switchgear having at least three switching gaps.

Three-phase switchgear of the type having three switching gaps is described in U.S. Pat. No. 3,873,797. In such known switchgear, it is intended that the switching gaps of the three phases close, as far as possible, simultaneously. Of course, such simultaneous closing of three switching gaps is not always achievable as a result of tolerances which must be observed during the manufacturing process. As a result, all of the contact points must be designed for the rated switching capacity of the unit and its anticipated service life. Accordingly, relatively large amounts of contact material are required.

It is, therefore, an object of this invention to provide switchgear of the type having at least three contact gaps wherein a small volume of contact material is sufficient, in comparison to known switchgear.

SUMMARY OF THE INVENTION

The foregoing and other objects are achieved by this invention which provides a three-phase switchgear having three switching gaps, wherein the movable contact of one switching gap leads the other two contacts in closing, and lags the other gaps during opening. In this manner, for a predetermined switching capacity, contact burnoff occurs substantially only at the other two switching gaps.

In accordance with the invention, contact burnoff is essentially limited to occur in only two of the current paths. The contacts across the switching gap which is offset in time require only very small volumes of expensive contact material. In addition, however, these small volumes of contact material need not consist of high quality contact material. For example, the contact material used in the small contacts may consist of AgNi, which can readily be welded as compared to AgCdO. Thus, at the end of the electrical service life of the switchgear, only the contacts of two current paths need to be replaced. It is advantage of this arrangement, therefore, that cost savings are achieved by reducing the number of spare contacts which are required to be maintained, and time savings are achieved during the inspection for contact replacement.

Although it is known, illustratibely from German Reference DE-AS No. 23 46 928, to connect in a manually operated pushbutton switch having relatively small switching capacity, two contact bridges in series wherein one is provided without contact overlay, and the other is provided with a contact overlay on only one side so that only the contact point which is provided with the contact overlay is to assume the switching function, the switching capacity which is necessary in industrial switchgear cannot be achieved by this known arrangement. Moreover, such an arrangement produces relatively high contact resistances at the contact points which do not have contact overlay, and such contact resistances may change during the course of operation. The design of the contact points in accordance with the invention can therefore be utilized to advantage if the contact points are the bridge contact arrangements of an electromagnet switching device.

The present inventive arrangement can also be generally used in apparatus wherein certain switching gap lengths are required in the open condition if the opening distances of the open switching gaps correspond to the required separating paths. Further substantial savings of expensive contact material, illustratively silver, can be achieved if one switching point is equipped with a contact volume which is reduced by at least 70% as compared to the other two switching points, or if the arc quenching device of one switching point is equipped only with parts of the quenching device of the other two switching points. Further savings with respect to the production of switchgear can be achieved if contact parts such as the leads of one switching point are fastened permanently to the switchgear, and if the lead or lag of one switching point can be achieved by fixed contact pairs which are arranged at different heights. It is advantageous in such embodiments to provide intermediate layers between the housing and the fixed contact pair.

BRIEF DESCRIPTION OF THE DRAWING

Comprehension of the invention is facilitated by reading the following detailed description in conjunction with the annexed drawing which is a partially cross-sectional, perspective view of an illustrative embodiment of the invention.

DETAILED DESCRIPTION

The drawing shows switchgear constructed in accordance with the principles of the invention having a housing 1 in which are fixed a magnet 2 having a coil 3. The switchgear further contains a plurality of fixed contact pairs 4, 5, and 6. A contact bridge carrier 7 is connected to a movable magnet part 8, the contact bridge carrier being movable therewith. Contact bridge carrier 7 holds a plurality of contact bridges 11, 12, and 13 in window-like openings 9 and 10. The contact bridges are urged against stops 15 and 16 by respective pressure springs 14. In this embodiment, stops 16 for contact bridge 12 is located deeper than stops 15 by a depth differential 17 which is indicated in the drawing by an arrow. In this manner, contact bridge 12 comes into contact with fixed contact pair 5 earlier than contact bridges 11 and 13 come into contact with fixed contact pairs 4 and 6.

Upon closing of the switchgear, the switching point which if formed by contact bridge 12 and fixed contact pair 5 is produced earlier in time relative to the contact point of the other two phases. It is also evident that, in this embodiment, this switching point is opened later in time than the other switching points when the switchgear is deenergized. In this manner, the actual switching function is achieved by contact bridges 11 and 13 with fixed contact pairs 4 and 6. This arrangement permits relatively thin contact overlays 18 to be applied on contact bridge 12 and fixed contact pair 5, respectively. It is a further advantage that since the contact burn off occurs essentially only in the current paths formed by contact bridges 11 and 13 with fixed contact pairs 4 and 6, as compared to three current paths experiencing contact burnoff is known arrangements, the contact material of the two current paths is better utilized.

It is a further advantage of the present invention that the known design of quenching baffles, arc conduction parts, etc., such as arc quenching device 19 which is shown fragmented in the drawing, can be reduced substantially for the one switching point.

The foregoing invention can be realized without requiring a new design for the switchgear. Moreover, the usual contact design can be retained. It is only necessary to make window-like opening 10 somewhat larger than openings 9 so that stop 16 can be located lower. Moreover, the amount by which the stop is lowered, illustratively distance differential 17, must take into consideration the reduction in thickness of the contact overlay. Alternatively, the expense of producing window openings of different dimensions can be eliminated by interposing intermediate layers (not shown in the drawing) between the housing and fixed contact pair 5.

Although the invention has been described in terms of specific embodiments and applications, it is to be understood that persons skilled in the art, in light of this teaching, can produce additional embodiments without departing from the spirit of exceeding the scope of the claimed invention. Accordingly, the drawing and description in this disclosure are proffered to facilitate comprehension of the invention and should not be construed to limit the scope thereof.

What is claimed is:

1. A switchgear apparatus of the type having at least three switching gaps for interconnecting three electrical phases, each switching gap having at least an associated movable contact and a substantially fixed contact, each of the switching gaps further having a predetermined open state spacing between the movable and substantially fixed contacts when said switchgear apparatus is in an open state, the switchgear apparatus further comprising means associated with a selected one of the switching gaps for altering the predetermined open state spacing of the movable and substantially fixed contacts associated with said selected one of the switching gaps so that the associated contacts close earlier than the contacts associated with the other switching gaps during a closure cycle of the switchgear apparatus, and open later than the contacts associated with the other switching gaps during an opening cycle of the switchgear apparatus.

2. The switchgear apparatus of claim 1 wherein said predetermined open state spacing between the movable and substantially fixed contacts of said switching gaps has predetermined minimum distance.

3. The switchgear apparatus of claim 2 wherein said movable and substantially fixed contacts associated with said selected one of the switching gaps are provided with contacts containing a volume of contact material which is reduced by at least 70% with respect to the volumes of contact material of the contacts associated with the other switching gaps.

4. The switchgear apparatus of claim 1, 2, or 3 wherein there is further provided a plurality of arc quenching means associated with respective ones of the switching gaps, said arc quenching means associated with said selected one of the switching gaps being the equivalent of only a portion of the arc quenching means associated with the other switching gaps.

5. The switchgear apparatus of claim 1, further comprising housing means for enclosing the movable and substantially fixed contacts associated with said switching gaps, the substantially fixed contacts being permanently coupled to said housing means.

6. The switchgear apparatus of claim 5 wherein said means associated with said selected one of the switching gaps for altering the predetermined open state spacing is operative to alter the height of the substantially fixed contact associated with said selected one of the switching gaps.

7. The switchgear apparatus of claim 6 wherein there are further provided intermediate layers interposed between said housing means and the substantially fixed contact associated with said selected one of the switching gaps.

* * * * *